US007389587B2

(12) United States Patent
Di Bitonto et al.

(10) Patent No.: US 7,389,587 B2
(45) Date of Patent: Jun. 24, 2008

(54) UTILITY KNIFE

(75) Inventors: Anthony Di Bitonto, Brooklyn, NY (US); Mark Prommel, New York, NY (US); Goeran Jerstroem, Brooklyn, NY (US); Conor McNamara, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 40 days.

(21) Appl. No.: 11/222,146

(22) Filed: Sep. 8, 2005

(65) Prior Publication Data

US 2007/0050988 A1 Mar. 8, 2007

(51) Int. Cl.

| | |
|---|---|
| ***B26B 3/06*** | (2006.01) |
| ***F41B 13/02*** | (2006.01) |
| ***F41C 27/18*** | (2006.01) |
| *B26B 11/00* | (2006.01) |

(52) U.S. Cl. ..... 30/162; 30/161; 30/163; 30/125

(58) Field of Classification Search ..... 30/162, 30/161, 163, 333, 329, 331, 335, 125
See application file for complete search history.

(56) References Cited

U.S. PATENT DOCUMENTS

| | | | | |
|---|---|---|---|---|
| 2,187,590 | A | 1/1940 | Lurie | |
| 2,313,598 | A * | 3/1943 | Stock | 30/331 |
| 3,509,627 | A | 5/1970 | Gilbert et al. | |
| 3,593,417 | A | 7/1971 | West | |
| 3,604,113 | A | 9/1971 | Cuscovitch | |
| 3,660,895 | A | 5/1972 | West | |
| 3,708,881 | A | 1/1973 | Bennett | |
| 3,829,967 | A | 8/1974 | Gilbert | |
| 3,845,554 | A | 11/1974 | Joanis et al. | |
| 3,872,591 | A | 3/1975 | Quenot | |
| 3,879,847 | A | 4/1975 | Roll | |
| 3,906,625 | A * | 9/1975 | Gringer | 30/125 |
| 3,927,473 | A | 12/1975 | Braginetz | |
| 3,943,627 | A | 3/1976 | Stanley, Jr. | |
| 3,964,162 | A | 6/1976 | Gerson et al. | |
| 4,005,525 | A | 2/1977 | Gringer | |
| 4,068,375 | A | 1/1978 | Rathburn et al. | |
| 4,196,515 | A | 4/1980 | Sugiyama | |
| 4,227,306 | A | 10/1980 | Meshulam | |
| 4,261,104 | A | 4/1981 | Cuscovitch | |
| 4,408,396 | A | 10/1983 | Scholl | |
| 4,425,709 | A | 1/1984 | Quenzi | |
| 4,524,518 | A | 6/1985 | West | |
| 4,575,940 | A | 3/1986 | Wenzel | |
| 4,586,256 | A | 5/1986 | Weimann | |
| 4,604,805 | A * | 8/1986 | Krieger | 30/330 |

(Continued)

*Primary Examiner*—Joseph J. Hail, III
*Assistant Examiner*—Alvin J Grant
(74) *Attorney, Agent, or Firm*—Seyfarth Shaw LLP

(57) ABSTRACT

A utility knife which includes a feature for presenting a user with a replacement blade holder containing replacement blades when the separate halves of the knife body, referred to as handle portions, are opened to expose an interior cavity is disc losed. A pivotable latching lever selectively movable between a latched position and an unlatched position permits the two handle portions to pivot relative to one another about a pivot axis when the lever is in the unlatched position so that the replacement blade holder may be presented to the user. The disclosed utility knife having a replacement blade holder and a latching lever is capable of very economic manufacture, yet is dependable in operation.

21 Claims, 6 Drawing Sheets

U.S. PATENT DOCUMENTS 4,612,707 A 9/1986 Shea
4,662,070 A 5/1987 Reddig
4,706,385 A 11/1987 Iten
4,884,342 A 12/1989 McNamra et al.
4,922,610 A 5/1990 Szabo
4,936,014 A 6/1990 Shaanan et al.
4,939,839 A 7/1990 Gorst
5,005,290 A 4/1991 Gilbert
5,301,428 A 4/1994 Wilcox
5,303,474 A 4/1994 Keklak et al.
5,386,632 A 2/1995 Schmidt
5,404,645 A 4/1995 Janser
5,426,855 A * 6/1995 Keklak et al. ..... 30/162
5,613,300 A 3/1997 Schmidt
5,784,788 A 7/1998 Cothery
5,862,596 A 1/1999 Chung
5,864,952 A 2/1999 Chung
5,878,501 A 3/1999 Owens et al.
5,890,294 A 4/1999 Keklak et al.
5,940,970 A 8/1999 D'Ambro, Sr. et al.
6,000,136 A 12/1999 Owens
6,026,575 A 2/2000 Wonderley
6,131,292 A 10/2000 Reddig
6,163,963 A 12/2000 Huang
6,233,830 B1 5/2001 Lamond et al.
6,330,749 B1 12/2001 Khachatoorian et al.
6,349,473 B1 2/2002 Schmidt
6,370,783 B1 4/2002 Bozikis et al.
6,449,850 B1 9/2002 Gilbert
6,453,559 B1 * 9/2002 Marshall et al. ..... 30/2
6,560,873 B1 5/2003 Ortner et al.
6,574,872 B2 * 6/2003 Roberts et al. ..... 30/330
6,718,637 B1 4/2004 Ortner et al.
6,807,738 B1 10/2004 Shih et al.
6,813,833 B2 11/2004 Saunders et al.
6,829,827 B2 12/2004 Tseng
6,845,561 B2 1/2005 Timson
6,971,178 B2 * 12/2005 Rowlay ..... 30/162
2002/0162229 A1 * 11/2002 Roberts et al. ..... 30/330
2003/0037444 A1 * 2/2003 Chunn ..... 30/337

* cited by examiner

UTILITY KNIFE

TECHNICAL FIELD

The present invention relates generally to cutting devices and, more specifically, to a utility knife having an interior compartment housing replacement blades.

BACKGROUND

Utility knives are widely used in construction, business and hobby applications for cutting such materials as paperboard, wallboard, string and other objects. Commonly, such utility knives are in the form of an elongate hollow housing that can be gripped by the user along an intermediate portion thereof and into which there are placed trapezoidal flat cutting blades. The blades typically have a single cutting edge. The blade is typically slidably mounted between a retracted position within the housing and an extended position in which the cutting edge is at least partially exposed through a front end aperture or slot, the slot being coupled to a manually operated element, such as a button positioned in a manner convenient to be actuated by the user's hand.

Some utility knives include two mating halves secured to one another with a screw. A blade is fixed between the two halves and is released and replaced by removing the screw and separating the two halves. The screw is typically removed by using a screwdriver. Also, the two halves of these utility knives are often made from metal material.

The flat cutting blades used in utility knives are most useful and are easiest to use when the blades are extremely sharp. These blades, therefore, are frequently replaced once they become dull. For this purpose, known utility knives provide storage within the handle for additional blades so that these will be readily available when needed. In order to facilitate this replacement procedure, some utility knives provide a blade holder which stores the plurality of blades and which may be removed from the utility knife handle. However, these are disadvantaged in that once the holder is removed from the handle, there is nothing to prevent one or more of the blades from falling out. In the situation where the blade holder is not removable, the blade holder is not positionable to permit quick and convenient access to the replacement blades.

Thus, there is a need for a utility knife that presents a user with replacement blades contained therein by providing a replacement blade holder pivotally connected internally to the utility knife. A further need exists for a utility knife that includes a latching lever selectively movable between a latched position and an unlatched position, wherein handle portions of the utility knife can pivot relative to one another about a pivot axis when the lever is in the unlatched position.

SUMMARY

There is disclosed herein an improved utility knife which includes improved features for presenting a user with a replacement blade holder containing replacement blades.

It is an object of the invention to provide a utility knife which provides a replacement blade holder pivotally connected internally to the utility knife.

Another object of the invention is to provide a pivotable latching lever selectively movable between a latched position and an unlatched position, thereby permitting first and second handle portions to pivot relative to one another about a pivot axis when the lever is in the unlatched position so that the replacement blade holder may be presented to the user.

It is also an object of the invention to provide a utility knife having a replacement blade holder and a latching lever which is of very economical manufacture, yet is dependable in operation.

An illustrative embodiment of the present invention relates to a utility knife for carrying a blade to be used and replacement blades, including a first handle portion and a second handle portion pivotally interconnected between an open position and a closed position, a latching lever pivoted into and near the end of said first handle portion and being selectively movable between a latched position and an unlatched position, wherein the first and second handles can pivot relative to one another about a pivot axis when the lever is in the unlatched position, an actuator slidably mounted on one of the first and second handle portions, a blade carriage operatively coupled to said actuator to secure the blade, the actuator being operable to move the blade carriage between a retracted position and an extended position, and a compartment integrally formed in one of the first and second handle portions, a replacement blade holder pivotally connected to one of the first and second handles and adjacent to said compartment and pivotable away from the compartment to present spare blades to a user when the first and second handles are in the open position.

Another illustrative embodiment of the invention relates to a method for presenting replacement blades for a utility knife to a user, including the steps of positioning a latching lever into an unlatched position relative to first handle portion, pivoting the first handle portion relative to a second handle portion along a first axis, and pivoting a replacement blade holder containing replacement blades along a second axis substantially perpendicular to the first axis.

A more detailed explanation of the invention is provided in the following description and claims and is illustrated in the accompanying drawings.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
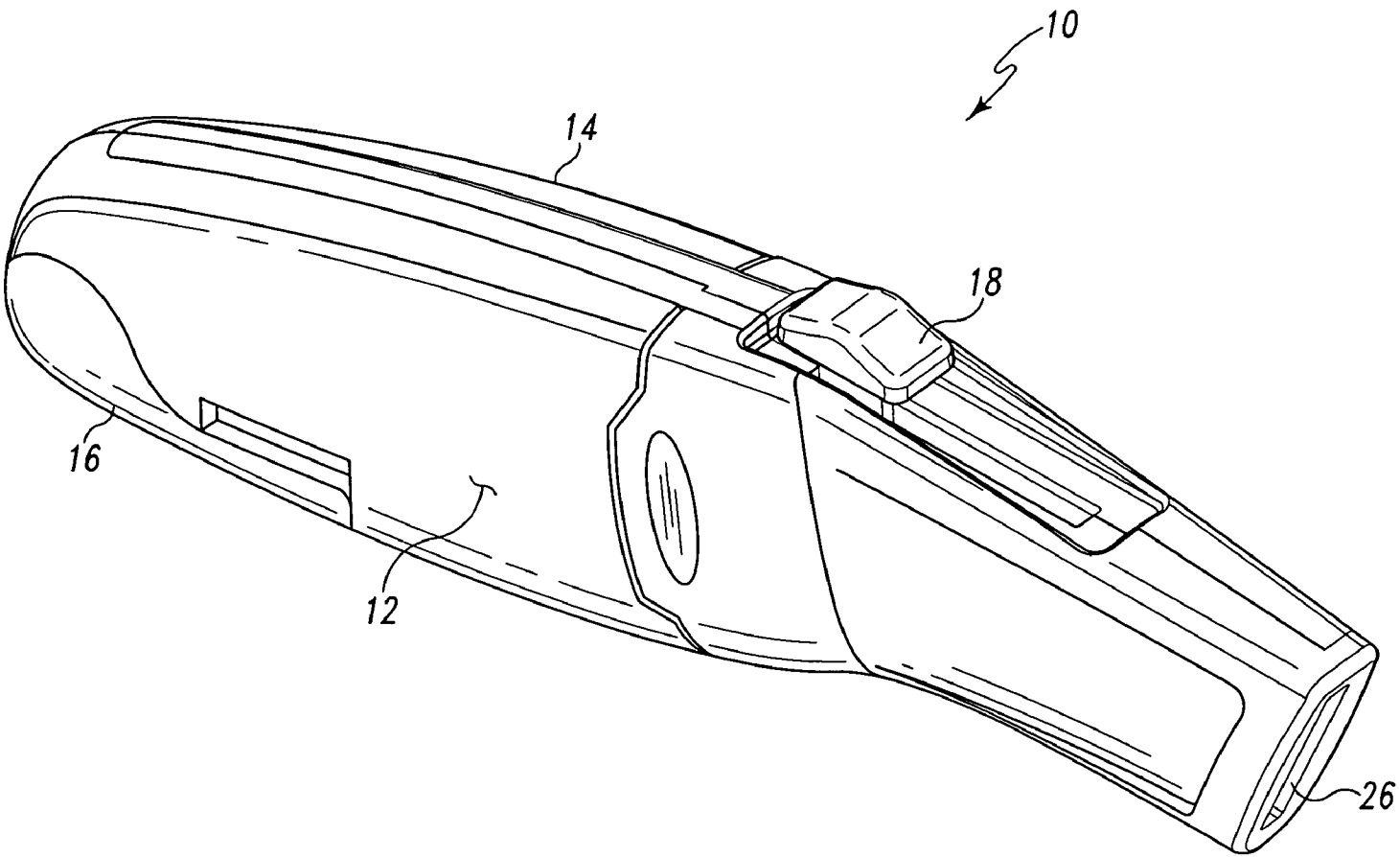
FIG. 1 is a perspective view of one embodiment of the present utility knife.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
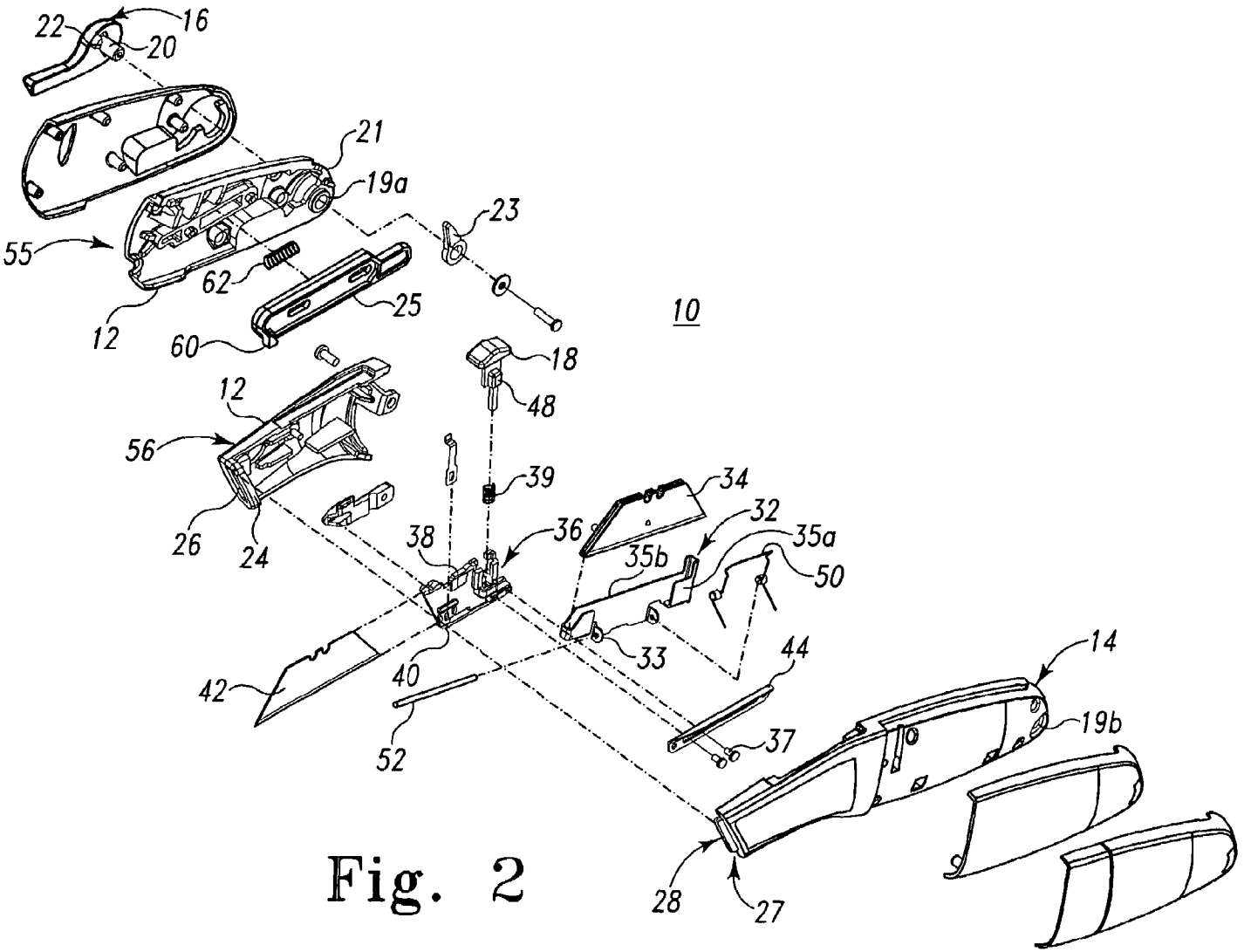
FIG. 2 is an exploded view of one embodiment of the present utility knife.

Referring to FIGS. 1 and 2, there is depicted a utility knife 10 which includes handle portions 12 and 14. The handle portions 12 and 14 preferably have an aperture formed on a peripheral side through which a blade actuator 18 can be extended through and into a compartment 17 (FIGS. 3-4) formed between the handle portions 12 and 14. The actuator 18 is provided to engage a blade, as discussed in detail below, and move the blade between a retracted position and an extended position. As is further detailed below, a latching lever 16 is provided to be selectively movable between a latched position and an unlatched position, so that when in the unlatched position the handle portions 12 and 14 can pivot relative to one another about an axis to expose compartment 17.

The handle portion 12 may be encased in an over-molded elastomeric material, such as rubber. Such an over-molded elastomeric material provides the user with a high grip surface, so that the utility knife 10 can be easily handled. Further, the handle portion 12 receives the latching lever 16 through an opening 19*a* in the end proximate to the user. An extension 20 of the latching lever 16 passes through the opening 19*a* to be received in a similar opening in handle portion 14, as discussed below. An aperture 21 is provided in handle portion 12 to receive a latch 22 of latching lever 16. The latch 22 engages a finger-like actuator 23 which in turn moves locking mechanism 25. Locking mechanism 25 includes a catch 60 at an end distal to the actuator 23. The catch 60 engages a suitable mechanism on handle portion 14 to lock the two handle portions, 12 and 14, together. When actuated by actuator 23, locking mechanism 25 disengages catch 60 to unlock the two handle portions. A spring 62 maintains locking mechanism 25 in a position which keeps catch 60 in an engaged (i.e., locked) position when released.

Distal end 24 of handle portion 12 incorporates an aperture 26 for permitting passage of a blade therethrough. As is further illustrated in FIG. 3, the internal side of handle portion 12 is dimensioned and configured to provide compartment portion 17 for blade storage as discussed herein.

Figure 5:
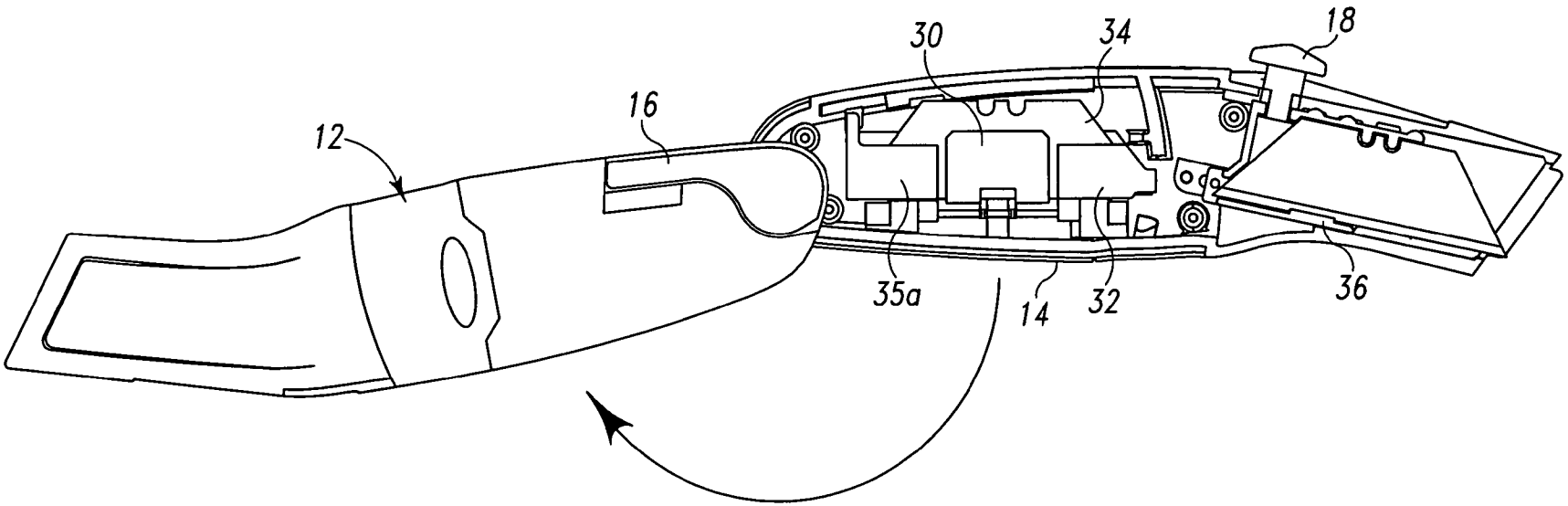
FIG. 5 is a side view of the utility knife of FIG. 2 shown in an open position.
Figure 6:
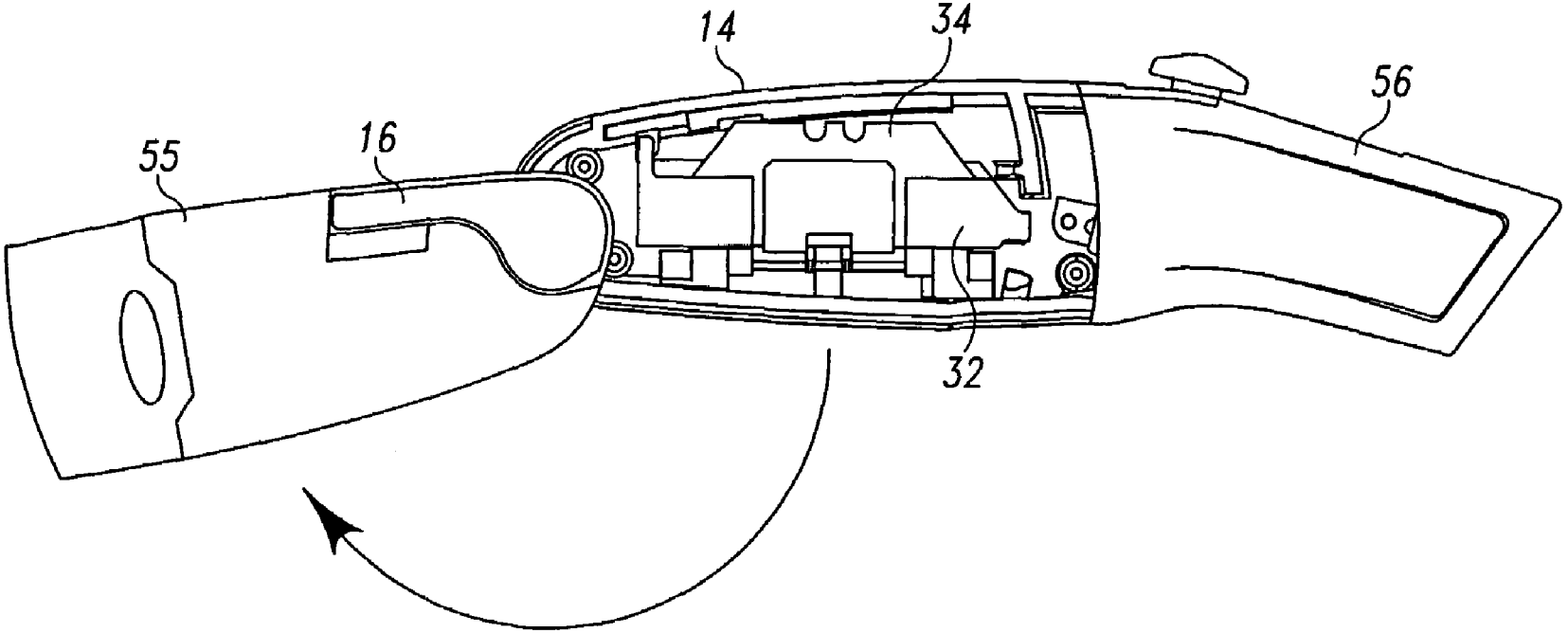
FIG. 6 is a side view of another embodiment of the present utility knife shown in an open condition.

As shown in FIGS. 5 and 6, the handle portions 12 and 14 are hinged together at the latching lever 16. FIG. 5 illustrates one embodiment of utility knife 10 where the entirety of the handle portion 12 is pivoted to an open position, exposing both blade holder 32 and blade carriage 36. Alternatively, as illustrated in the embodiment of FIG. 6, the rear section 55 of handle portion 12 may be pivoted to expose only the blade holder 32. The front section 56 of handle portion 12 may be permanently or removably affixed to handle portion 14 in this embodiment. The aspects of the latching lever 16 and blade holder 32 discussed herein, are substantially identical for each of these embodiments. Accordingly, unless otherwise specifically noted, no distinction is made below in discussing the structure and operation of the two utility knife embodiments.

The extension 20 of the latching lever 16 projects through the handle portion 12 into internal bosses 19*b* in the handle portion 14. In this manner, the extension 20 and its attachment point serve as the pivot point for handle portions 12 and 14. The handle portions 12 and 14 can be made of plastic or metal or other suitable material. Preferably, each of the handle portions 12 and 14 is made of a molded material, such as aluminum, plastic, or the like, whereby the various bosses, flanges, side rails and positioning means for various components can be manufactured integrally to the interior of the handle portions 12 and 14 without requiring numerous separate components.

Handle portion 14 may also be encased in an over-molded elastomeric material, such as rubber, so as to provide the user with a high grip surface for easy handling. The handle portion 14 of the embodiment illustrated in FIG. 6 includes a distal end 27 which terminates into a shoulder 28 (see FIG. 2). The shoulder 28 engages the distal end 24 of the front section 56 of handle portion 12 (FIG. 2) to help secure section 56 in place. With respect to the embodiment of FIG. 5, other components, such as stops (not shown), may be employed to preferably prevent rotation of handle portion 14 past handle portion 12 in a direction opposite that shown in FIG. 5.

Figure 7:
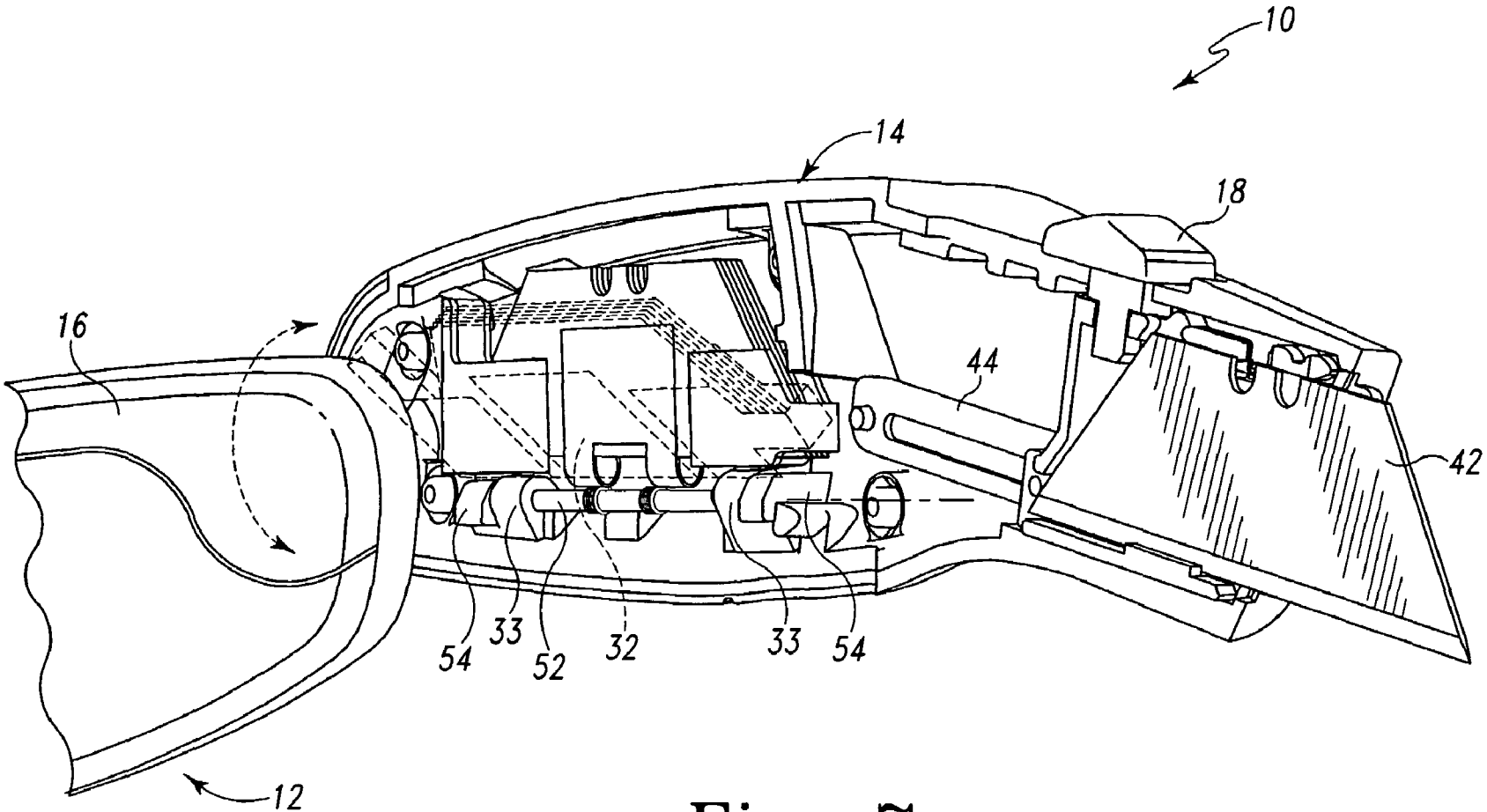
FIG. 7 is an enlarged perspective view of internal components of the utility knife of FIG. 5 with the blade holder advancing shown in phantom.

Handle portion 14 further includes a replacement blade holder 32 and a blade carriage 36. The replacement blade holder 32 stores replacement blades 34, which are retained in the blade holder 32 by a retaining clip 50. Preferably, retaining clip 50 is an independent component (e.g., see FIG. 2), but may be integrally formed as a part of blade holder 32 (e.g., see FIG. 7), and retains the replacement blades 34 under bias pressure as is known in the art. Additionally, the blade holder 32 further includes blade retaining walls 35*a* and 35*b*, which facilitate containment of the replacement blades 34 within the blade holder 32, and at least one rod support sleeve 33. Accordingly, once a replacement blade 34 is removed from the blade holder 32, the retaining clip 50 is biased towards retaining wall 35*b*, thereby securing the remaining replacement blades 34. The retaining clip 50 may also serve the added feature of biasing the blade holder 32 outward, as illustrated in FIG. 7, when the handle portions 12 and 14 are pivoted apart. As discussed in further detail below, rod support sleeves 33 receive a rod 52 to provide a pivotal engagement between handle portion 14 and blade holder 32.

The blade carriage 36 is operatively coupled to the actuator 18 so as to be preferably slidably mounted on the handle portion 14, thereby being operable to move the blade carriage 36 between a retracted position and an extended position. As depicted, the blade carriage 36 includes at least one blade locking flange 38 and a lower flange or track 40 to releasably secure a blade 42 to the blade carriage 36. The blade carriage 36 is slidably coupled to a track 44 by pins 37. The pins 37 pass through track 44 and are received by the blade carriage 36. As a result, the blade carriage 36 is capable of sliding along the track 44 when the actuator 18 is engaged by the user.

In operation, a spring 39 maintains constant bias pressure on the actuator 18 so as to maintain the position of a shoulder 48 between integral flanges of the handle portion 14, thereby preventing unintended movement of the blade carriage 36 along the track 44. When the user desires to extend or retract the blade carriage 36 into a position, the actuator 18 is depressed, thereby disengaging the shoulder from the flanges, and moved along the track 44 to the desired position.

As illustrated in FIGS. 5 and 6, the blade holder 32 is stored initially in the compartment 17 within handle portions 12 and 14. When the handle portions 12 and 14 are separated, the blade holder 32 moves to a position for presenting replacement blades 34 to a user, as shown in FIG. 7. As depicted, the blade holder 32 pivots away from the compartment 17 to present replacement blades 34 to the user when the handle portions 12 and 14 are in the open position to provide access to the compartment 17. Accordingly, the blade holder 32 is pivotally engaged to handle portion 14 through a rod 52 that passes through the rod support sleeves 33 and secured to rod supports 54 (FIG. 7), which are preferably integrally formed on handle portion 14. As mentioned previously, retaining clip or spring 50 can also be configured to bias the blade holder 32 outward. However, where an integral retaining clip is employed, or for any other purpose, a separate biasing member, such as a spring, resilient material, or the like, may be used to move blade holder 32 outward.

Figure 3:
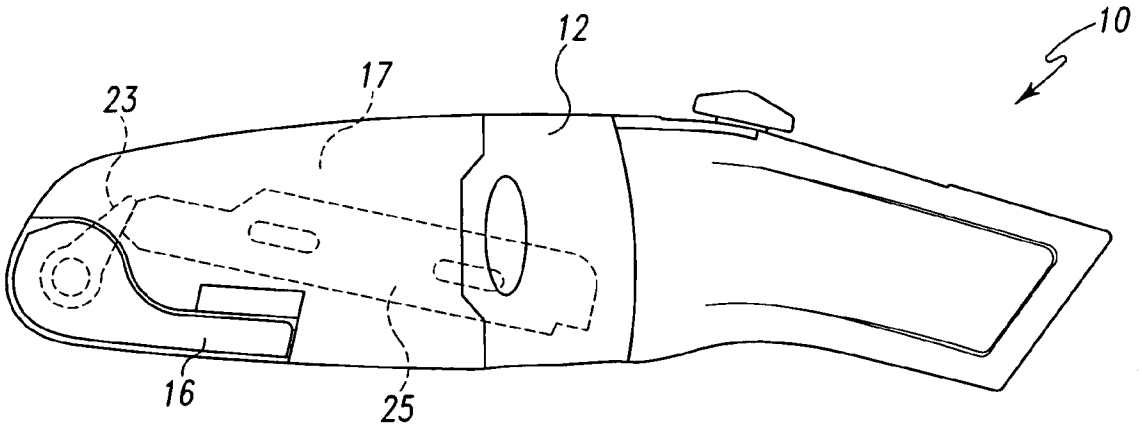
FIG. 3 is a side view of an embodiment of the present utility knife showing in phantom, the internal locking mechanism in a latched position.
Figure 4:
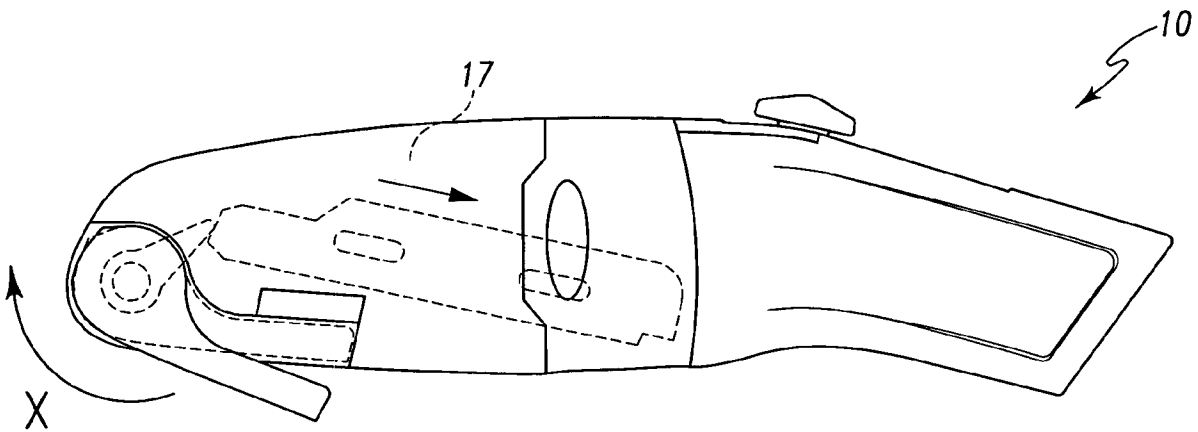
FIG. 4 is a side view of the utility knife of FIG. 2 showing, in phantom, the internal locking mechanism moving to an unlatched position.

As illustrated in FIG. 3, in operation, the user moves the latching lever 16 in the direction "X" to place the latching lever 16 into the unlatched position.

A utility knife as detailed herein may be utilized in various forms. One such utility knife may be useful for providing the replacement blades without the need of a removable blade holder or a blade holder that is difficult to manipulate. Another such utility knife may incorporate a mechanism adapted to cooperate with a pivoting blade holder, so as to permit the handle portions to rotate in a single direction, thereby protecting the blade holder. From the foregoing, it can be seen that there has been provided an improved utility knife which greatly facilitates the control of the presentation of replacement blades.

While the preferred embodiments described herein incorporate the lever actuated release mechanism in combination with the replacement blade holder 32, it should be understood that these components may be separately and independently incorporated into other embodiments of a utility knife. That is, for certain purposes it may be desirable to construct a utility knife which includes the latching lever 16 to facilitate opening of the knife halves. Conversely, other embodiments may incorporate the pivoting replacement blade holder 32 using most any prior art opening mechanism.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A utility knife comprising:

a first and second bundle portion pivotally connected together at a pivot point to form a substantially hollow body having an opening at one end for the extension of a blade therethrough, the first and second handle portions being capable of movement about the pivot point between an open condition and a closed condition, a latching mechanism housed within the body and configured to releasably lock the pivotally connected handle portions together in the closed condition, and a pivotable lever attached to the pivot point and positioned on an outer surface of one of either the first and second handle portions and engagably connected to the latching mechanism, wherein pivoting movement of the lever less than 360° from a first position to a second position operates the latching mechanism to release the pivotally connected handle portions to allow movement about pivot point into an open condition, and wherein the lever is biased to the first position.

2. The utility knife of claim 1, wherein the pivot point is positioned on an end of the body opposite the opening.

3. The utility knife of claim 1, wherein the outer surface of one of either the first and second handle portions comprises a recessed area and wherein the lever is configured to fit within the recessed area such that an outer surface of the lever is substantially flush with the outer surface of the handle portion having the recess.

4. The utility knife of claim 1, wherein the first and second body portions are substantially equal halves of the body.

5. The utility knife of claim 1, further comprising a blade holder pivotally attached within the hollow body and for holding spare blades.

6. The utility knife of claim 5, wherein the blade holder comprises a biasing member such that the blade holder is pivotally biased from the body when the first and second handle portions are in an open condition.

7. The utility knife of claim 1, wherein the latching mechanism is biased to a lock position.

8. The utility knife of claim 7, wherein the lever is biased to the first position by the latching mechanism.

9. The utility knife of claim 1, wherein the latching mechanism is biased to a lock position by the lever.

10. The utility knife of claim 1, wherein the latching mechanism comprises a sliding member slidably attached to an interior surface of one of either the first and the second handle portions.

11. The utility knife of claim 10, wherein the latching mechanism further comprises a fixed member attached to an interior surface of the other of the first and second handle portions.

12. A utility knife comprising:

a first handle portion and a second handle portion pivotally connected together by a pivot pin at an end of the first and second handle portions to form a substantially hollow rigid body having a slotted opening at an end opposite the pivot pin for the extension of a blade therethrough, the first and second handle portions being capable of limited movement about the pivot point between an open condition and a closed condition, a latching mechanism connected to an interior surface of one of either the first handle portion and the second handle portion and biased to releasably lock the pivotally connected first and second handle portions together in the closed condition by engaging a fixed component attached to an interior surface of the other of the first handle portion and second handle portion, and a pivotable lever attached to an exterior surface of one of either the first handle portion and the second handle portion at the pivot point and engagably connected to and biased by the latching mechanism, wherein the latching mechanism is responsive to pivoting movement of the lever less than 360° from a first position to a second position to release the pivotally connected handle portions and allow movement of the handle portions about the pivot point into an open condition, and wherein the outer surface of one of either the first and second handle portions comprises a recessed area and wherein the lever is configured to fit within the recessed area such that an outer surface of the lever is substantially flush with the outer surface of the handle portion having the recess.

13. The utility knife of claim 12, wherein the first and second body portions are substantially equal halves of the substantially hollow body.

14. The utility knife of claim 12, further comprising a blade holder pivotally attached within the hollow body and for holding spare blades.

15. The utility knife of claim 14, wherein the blade holder comprises a biasing member such that the blade holder is pivotally biased from the body when the first and second handle portions are in an open condition.

16. A utility knife comprising:

a first and second handle portion connected together to define an interior cavity and having an opening at one end for a blade within the cavity to extend therethrough, the first and second handle portions being capable of separation from one another to allow access to the cavity;

a movable blade holder attached within the cavity and capable of retaining a plurality of spare blades; and a biasing member coupled to the blade holder and a surface of the cavity such that the blade holder is biased outward from the cavity and moves outward as a result of the biasing when the first and second handle portions are separated, wherein the first and second handle portions are pivotally connected together at a pivot point.

17. The utility knife of claim 16, wherein the blade holder is pivotally attached to a surface of the cavity.

18. The utility knife of claim 16, further comprising a latching mechanism housed within the cavity and configured to releasably lock the connected handle portions together.

19. The utility knife of claim 18, further comprising a lever engagably contacting the latching mechanism through one of either the first and second handle portions to release the lock of the latching mechanism.

20. The utility knife of claim 18, wherein the latching mechanism is biased to a lock position.

21. A utility knife comprising:

a first and second handle portion pivotally connected together at a pivot point to form a substantially hollow body having an opening at one end for the extension of a blade therethrough, the first and second handle portions being capable of movement about the pivot point between an open condition and a closed condition, a latching mechanism housed within the body and configured to releasably lock the pivotally connected handle portions together in the closed condition, a pivotable lever pivotally attached to an outer surface of one of either the first and second handle portions and engagably connected to the latching mechanism, and a blade holder pivotally attached within the hollow body and for holding spare blades, wherein pivoting movement of the lever less than 360° from a first position to a second position operates the latching mechanism to release the pivotally connected handle portions to allow movement about the pivot point into an open condition, wherein the blade holder comprises a biasing member such that the blade holder is pivotally biased from the body when the first and second handle portions are in an open condition.

* * * * *

UNITED STATES PATENT AND TRADEMARK OFFICE

CERTIFICATE OF CORRECTION

PATENT NO. : 7,389,587 B2
APPLICATION NO. : 11/222146
DATED : June 24, 2008
INVENTOR(S) : Anthony Di Bitonto et al.

It is certified that error appears in the above-identified patent and that said Letters Patent is hereby corrected as shown below:

Column 5

Claim 1; line 57 "about pivot" should be --about the pivot--.

Signed and Sealed this

Fourteenth Day of October, 2008

JON W. DUDAS
*Director of the United States Patent and Trademark Office*